US008572787B2

(12) United States Patent
Toguchi

(10) Patent No.: US 8,572,787 B2
(45) Date of Patent: Nov. 5, 2013

(54) ALIGNED SUPPORT BRIDGE

(76) Inventor: David S. Toguchi, Euclid, OH (US)

( * ) Notice: Subject to any disclaimer, the term of this patent is extended or adjusted under 35 U.S.C. 154(b) by 0 days.

(21) Appl. No.: 13/346,727

(22) Filed: Jan. 10, 2012

(65) Prior Publication Data

US 2013/0174360 A1 Jul. 11, 2013

(51) Int. Cl.
*E01D 11/00* (2006.01)

(52) U.S. Cl.
USPC ..... 14/18; 14/21; 14/22

(58) Field of Classification Search
CPC ..... E01D 11/04
USPC ..... 14/73, 74.5–78, 18–22
See application file for complete search history.

(56) References Cited

U.S. PATENT DOCUMENTS 316,597 A * 4/1885 Barnett ..... 14/32
1,515,251 A * 11/1924 Graves ..... 104/27
1,543,080 A * 6/1925 Graves ..... 404/1
3,247,539 A * 4/1966 Pleasants ..... 14/19
3,359,587 A * 12/1967 Pleasants ..... 14/19
3,406,616 A * 10/1968 McLean ..... 404/1
4,069,765 A * 1/1978 Muller ..... 104/123
4,272,210 A * 6/1981 Shoji et al. ..... 404/1
4,592,673 A * 6/1986 Lee ..... 404/1
7,469,438 B2 * 12/2008 Li et al. ..... 14/24
7,857,543 B2 * 12/2010 Troster ..... 404/1

* cited by examiner

*Primary Examiner* — Raymond W Addie
(74) *Attorney, Agent, or Firm* — DA Stauffer Patent Services LLC

(57) ABSTRACT

A bridge deck suspended from a support beam where the deck describes a laterally curved shape, for example an arch having an apex between two deck ends. The support beam describes a laterally curved shape similar to that of the deck, for example an arch having an apex and two ends opposite to the apex that are secured in a base (foundation) in the ground. The support beam is generally inclined from the support's base foundations to the apex at an angle sufficient to position the support above the deck. The support's relative position, dimensions and shape are such that the majority of the supporting beam is above and approximately horizontally aligned with corresponding points of the deck, thereby allowing suspension cables to extend near vertically between attachment points on the support beam and corresponding attachment points on the aligned portions of the deck.

20 Claims, 8 Drawing Sheets

ALIGNED SUPPORT BRIDGE

TECHNICAL FIELD OF THE INVENTION

The present invention relates to bridge structures, and, more particularly to bridge structures that incorporate a laterally curved deck.

BACKGROUND OF THE INVENTION

Using an arch to support a bridge is well known, and has been variously employed for hundreds of years. Until very recently, the bridge deck being supported by one or more arches has been substantially straight, at least for each section that is within the span of the arch. In some recent bridge designs, a horizontally (laterally) curved deck is suspended by suspension members (e.g., cables) extending down to it from an overhead arch that is more vertical than horizontal. In these prior art designs, the suspension members are necessarily angled with respect to portions of the deck because the arch is not directly above most of the deck's length. The more that the deck is curved, the more this affects the angle of the suspension members. Obviously cables that slant at a significant angle across the deck will interfere with persons and/or vehicles passing along the deck. Furthermore, instead of simply hanging from (vertical) suspension members attached to both sides of the deck, the deck is additionally given unbalanced lateral stress forces that cause tension, compression, bending, and/or torsion.

The prior art practice to resolve this problem includes, for example, some form of outrigger that laterally extends the deck's side, or for example, provides an intermediate structure around which the suspension members can wrap to change to a more nearly vertical orientation at the deck edge. These accommodations require extra strengthening structure in and around the deck, thereby increasing the complexity, bulk, and cost of the structure.

It is an object of the present invention to provide a method for supporting horizontally curved decks that doesn't require so much deck structure to handle.

BRIEF SUMMARY OF THE INVENTION

In a broad form, the present invention concerns a bridge structure 100 that includes:

- A bridge deck 105 that is supported from above by (suspended from) a support beam 102, wherein the deck 105 describes a laterally curved shape 125 and is generally inclined or declined at a first angle relative to horizontal, wherein the angle can be positive, zero, or negative, but is generally a relatively small angle, thereby making the deck's lateral curve 125 predominantly horizontal. In a preferred embodiment, the deck's curve 125 may be described as a mostly planar arch having an apex 115 between two deck ends distal to the apex 115. The term "arch" is used loosely herein to mean a freeform curve that extends from deck end to deck end while generally undergoing a "U-turn".
- A support 102 (e.g., a beam) that describes a laterally curved shape similar to that of the deck, for example having an apex 112 and two ends distal to the apex and each beam end being secured in a base 108, 109 (e.g., foundation in the ground 380). The support beam 102 is generally inclined from the support's bases 103 to the apex 112 at a second angle relative to horizontal that is greater than the deck's first angle, and sufficient to position the support 102 above the deck 105.

- The support's relative position, dimensions and shape are such that the majority of the supporting beam 102 is above and approximately horizontally aligned with corresponding points of the deck 105, thereby allowing suspension members 104 to extend substantially vertically between attachment points on the support beam 102 and corresponding attachment points on the aligned portions of the deck 105. The advantage of this arrangement is that stresses on the deck 105 are kept to a minimum, therefor even a deeply curved deck 105 can be made with lightweight, inexpensive materials. Especially for non-vehicular use, the deck 105 can thus be very thin which means that the deck's vertical rise can be minimized.

Several factors become evident after consideration of the basic concept. For example, since non-aligned parts of a bridge 100 will require a stronger portion of decking, it is advantageous to maximize the aligned portion of the support arch 102, Therefor, the bases of the support beam will likely be fixed at locations fairly close to the deck's corresponding ends 106*a*, 106*b* (the closer the better), and the supporting beam 102 will "lean" in the same general direction as the deck 105. Other factors will be discussed in the following disclosure.

Other objects, features and advantages of the invention will become apparent in light of the following description thereof.

BRIEF DESCRIPTION OF THE DRAWINGS

Reference will be made in detail to preferred embodiments of the invention, examples of which are illustrated in the accompanying drawing figures. The figures are intended to be illustrative, not limiting. Although the invention is generally described in the context of these preferred embodiments, it should be understood that it is not intended to limit the spirit and scope of the invention to these particular embodiments.

Certain elements in selected ones of the drawings may be illustrated not-to-scale, for illustrative clarity. The cross-sectional views, if any, presented herein may be in the form of "slices", or "near-sighted" cross-sectional views, omitting certain background lines which would otherwise be visible in a true cross-sectional view, for illustrative clarity.

Elements of the figures can be numbered such that similar (including identical) elements may be referred to with similar numbers in a single drawing. For example, each of a plurality of elements collectively referred to as 199 may be referred to individually as 199*a*, 199*b*, 199*c*, etc. Or, related but modified elements may have the same number but are distinguished by primes. For example, 109, 109', and 109" are three different versions of an element 109 which are similar or related in some way but are separately referenced for the purpose of describing modifications to the parent element (109). Such relationships, if any, between similar elements in the same or different figures will become apparent throughout the specification, including, if applicable, in the claims and abstract.

Figure 1A:
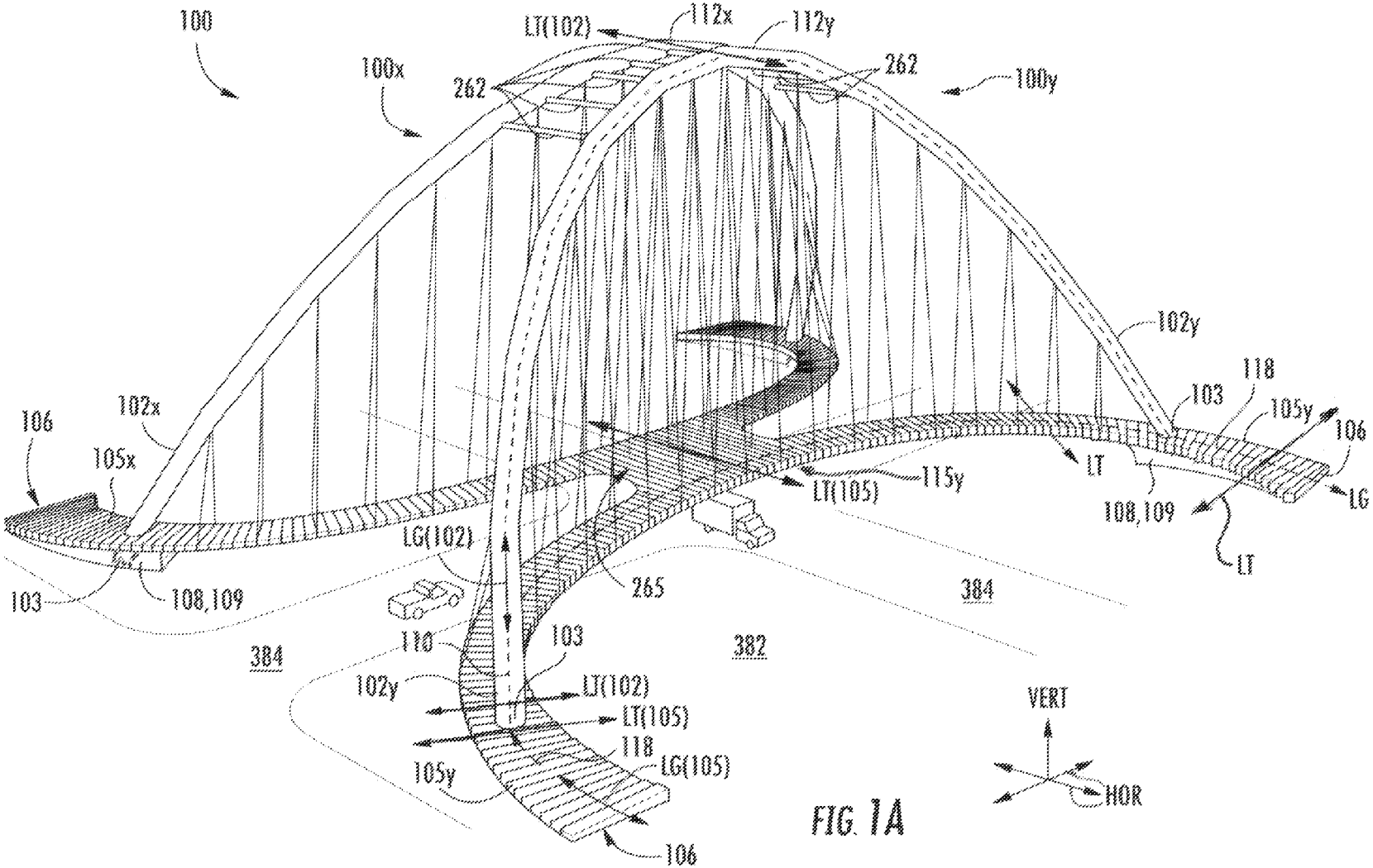
Figure 1B:
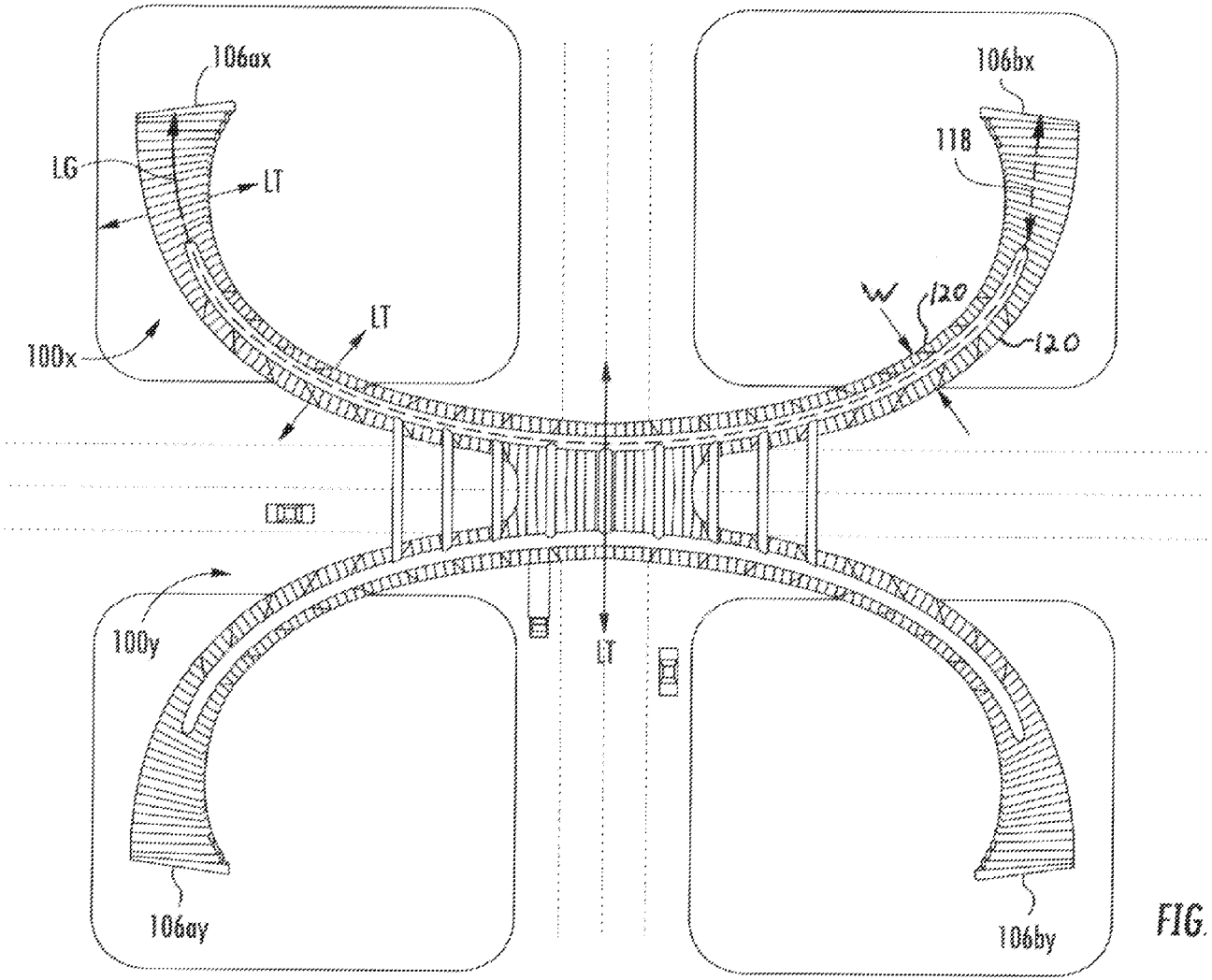

The structure, operation, and advantages of the present preferred embodiment of the invention will become further apparent upon consideration of the following description taken in conjunction with the accompanying drawings, wherein:

FIGS. 1A and 1B are perspective and plan views, respectively, of a double bridge structure, according to an embodiment of the invention.

Figure 2A:
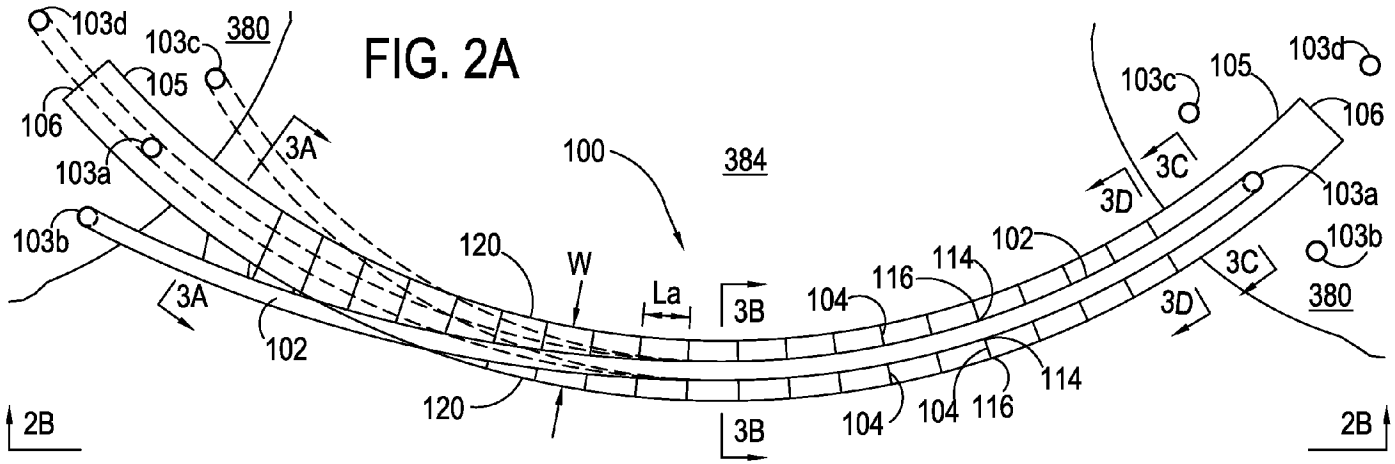
Figure 2B:
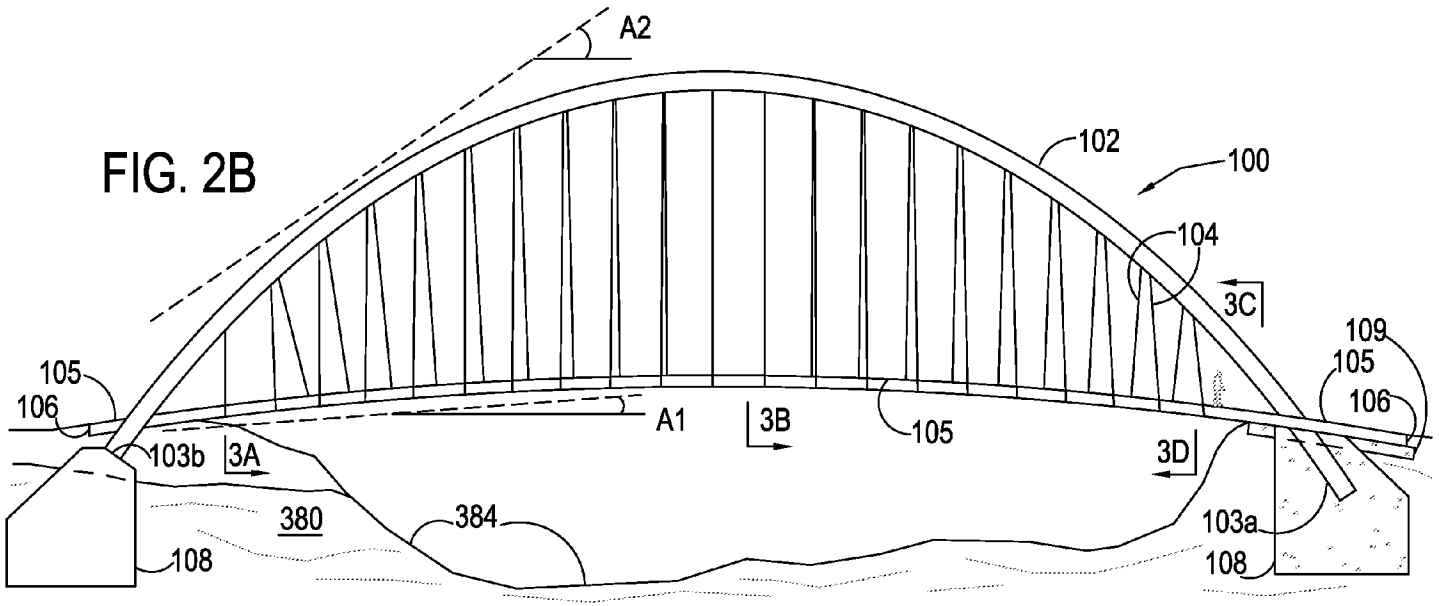

FIGS. 2A and 2B are plan and long side elevation views, respectively, of a single bridge structure, according to an embodiment of the invention.

FIGS. 3A to 3D are cross-section views at different points along the bridge structure of FIGS. 2A-2B, wherein the respective view locations are indicated by lines 3A-3A, 3B-3B, 3C-3C, and 3D-3D shown in FIG. 2A.

Figure 4A:
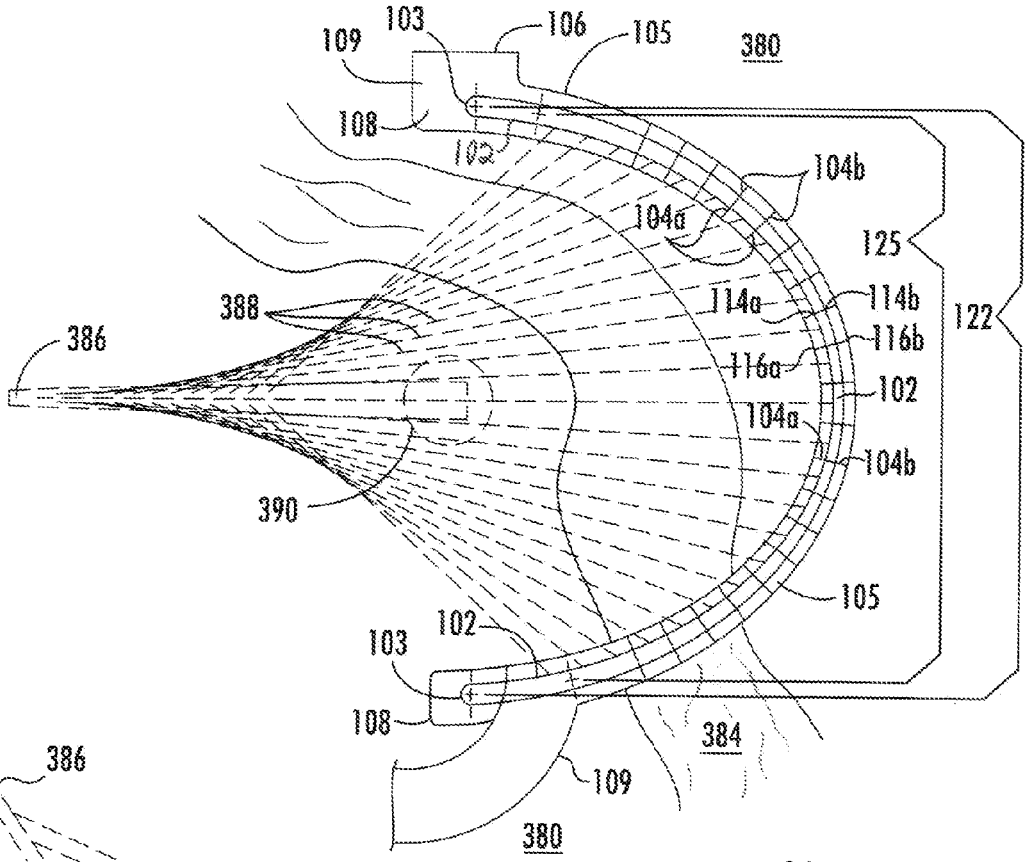
Figure 4B:
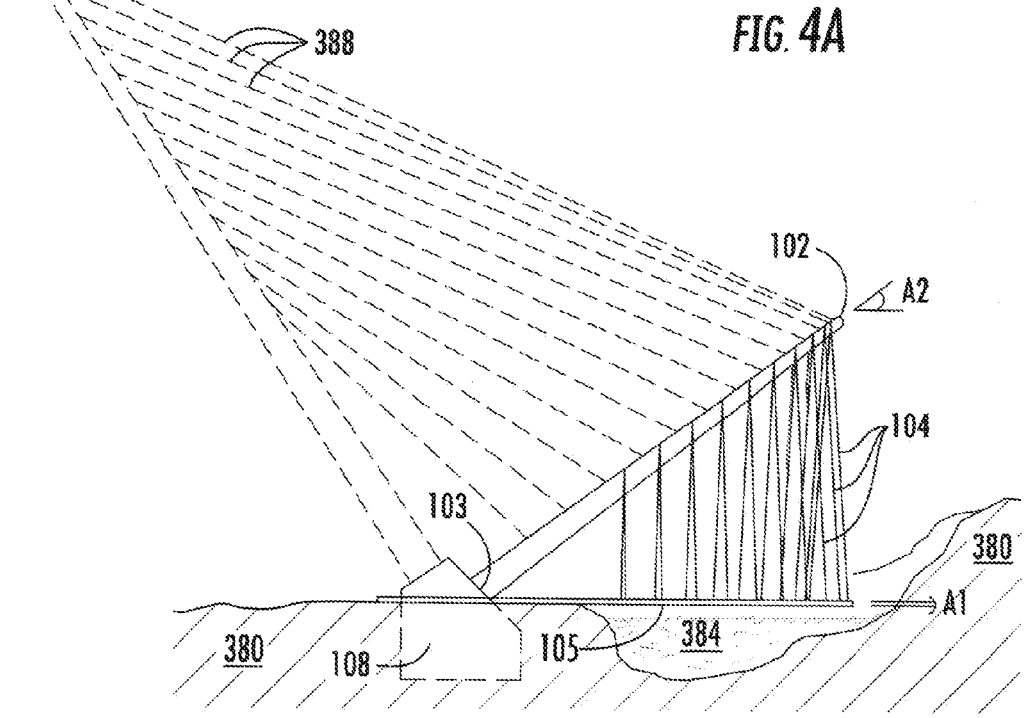

FIGS. 4A and 4B are plan and short side elevation views, respectively, of a single bridge structure, according to another embodiment of the invention.

Figure 5A:
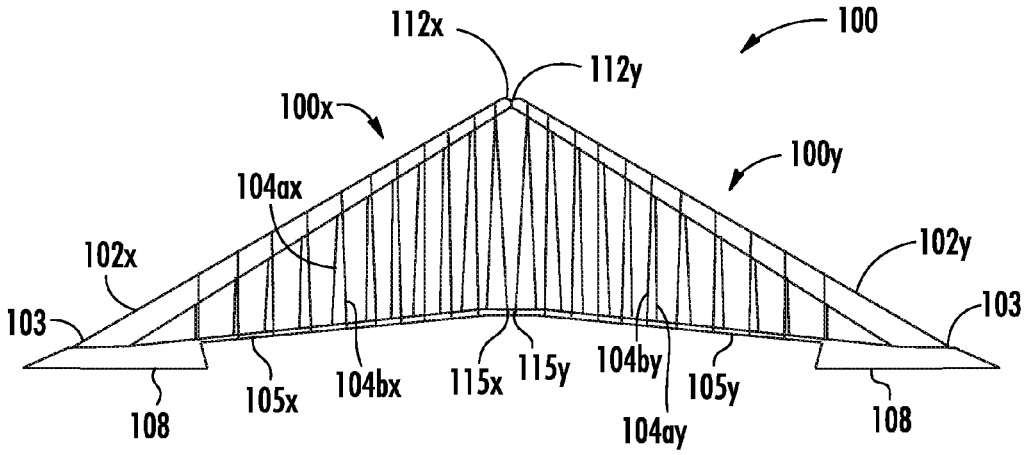
Figure 5B:
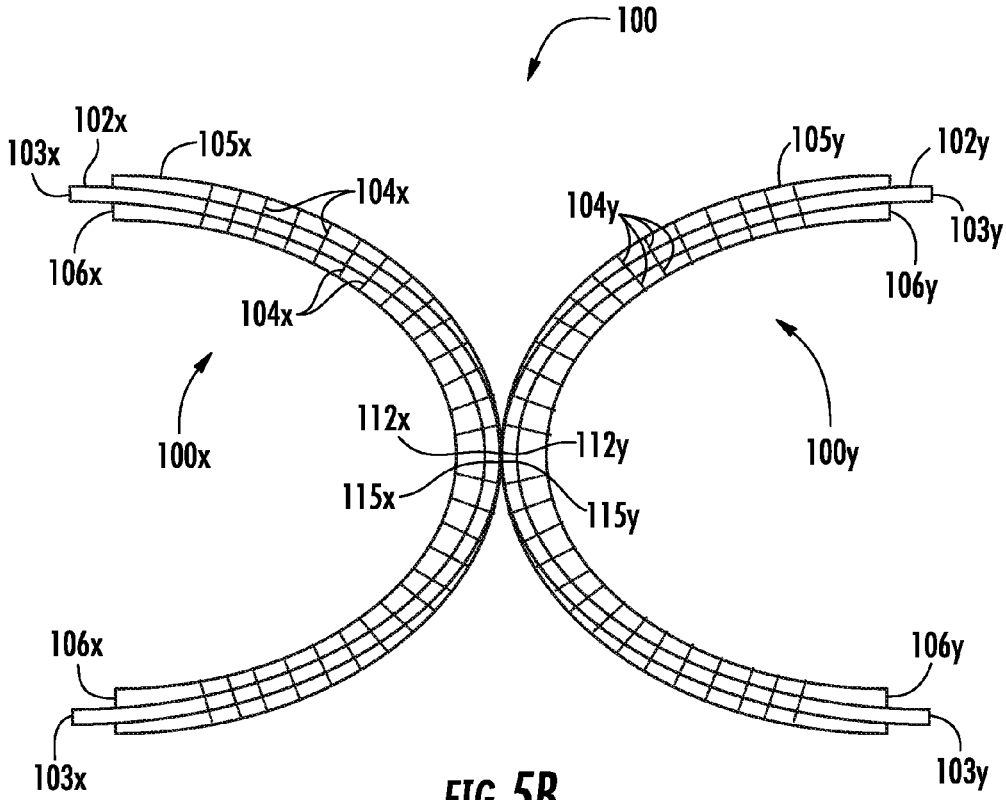

FIGS. 5A and 5B are long side elevation and plan views, respectively, of a double bridge structure, according to another embodiment of the invention.

Figure 3A:
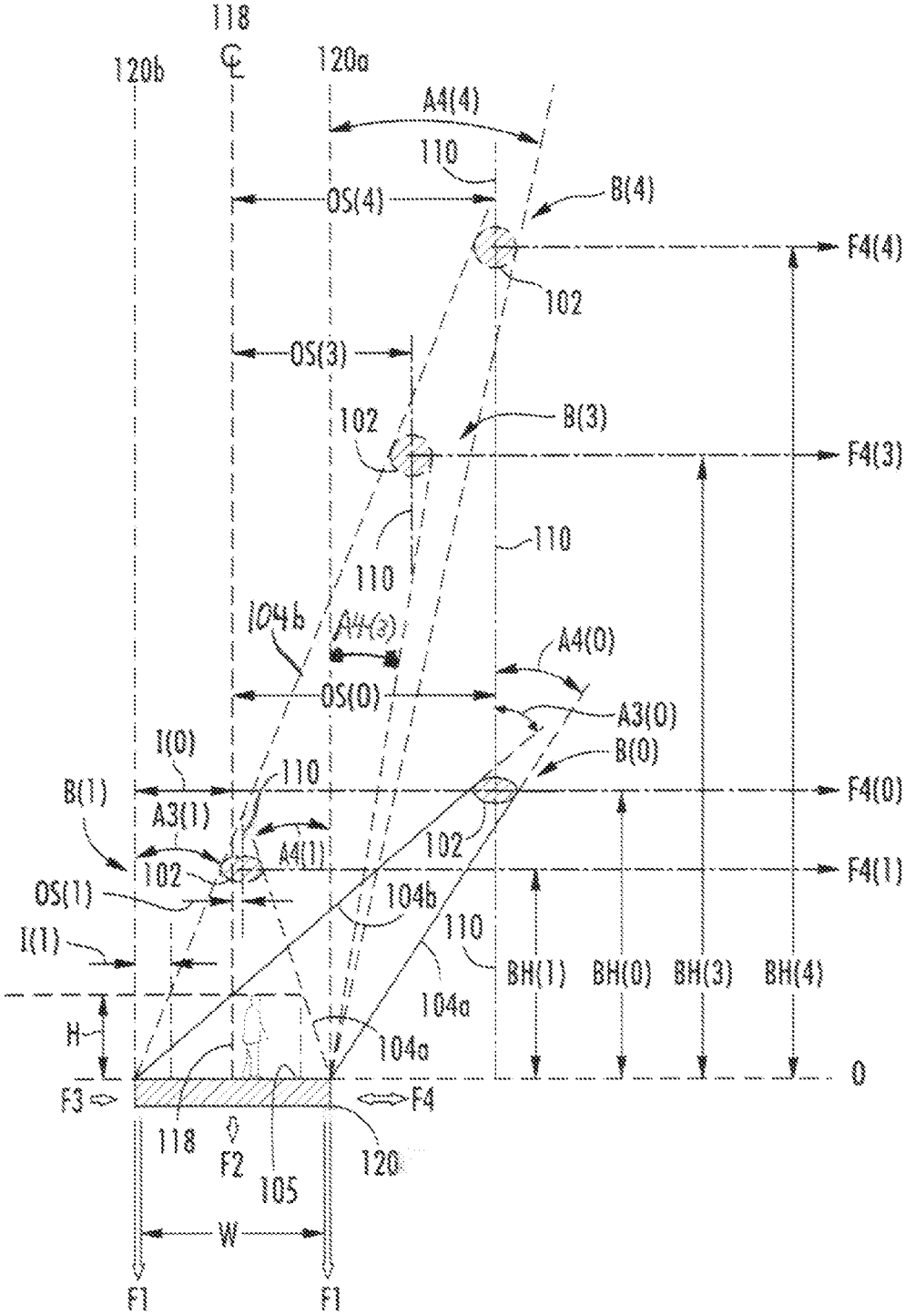
Figure 3B:
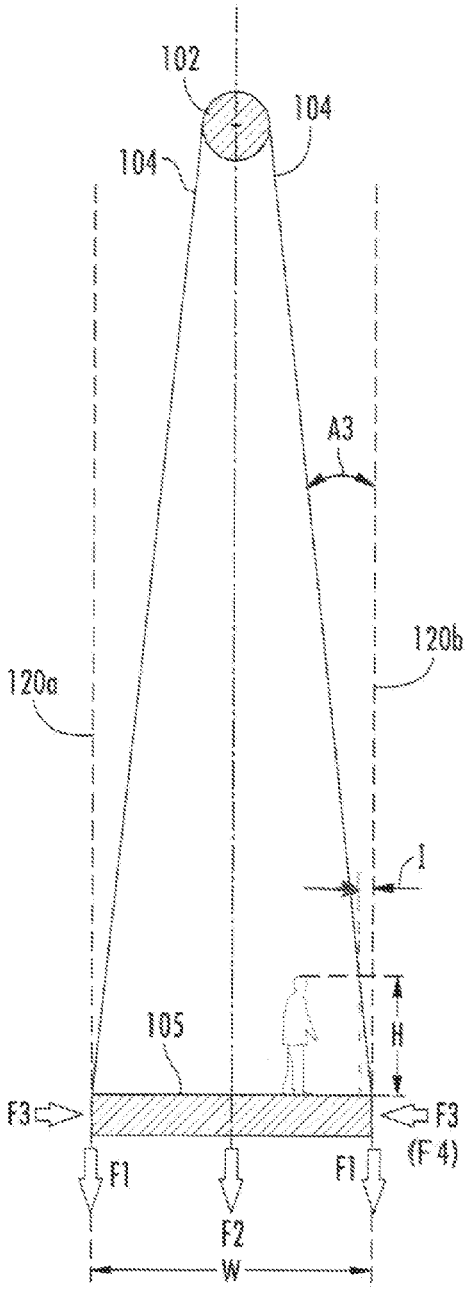
Figure 3C:
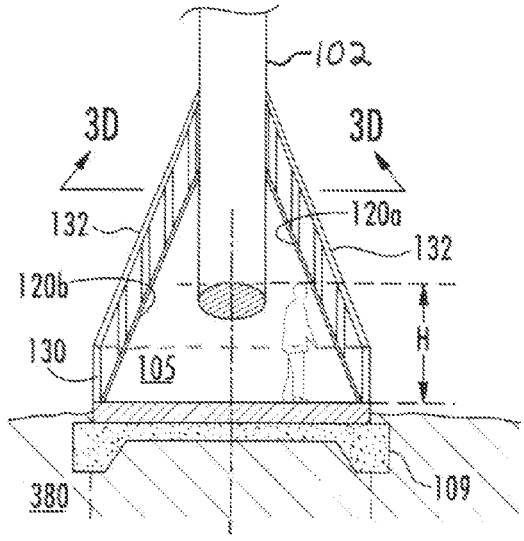
Figure 3D:
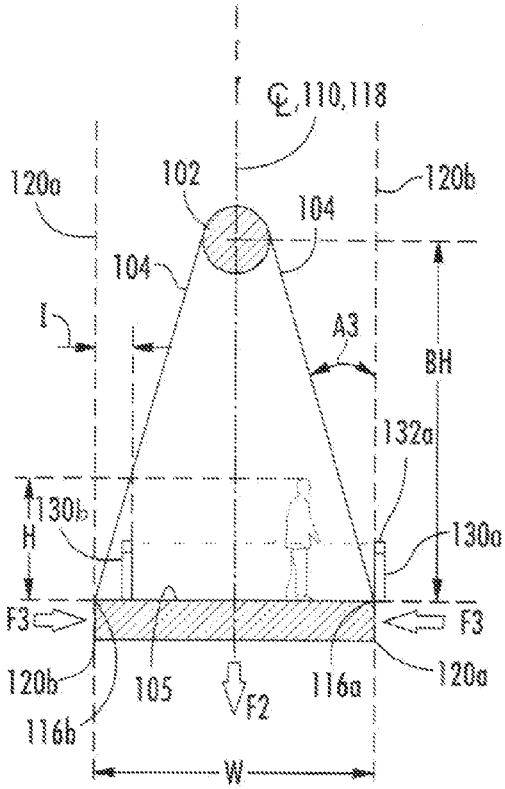

FIGS. 6A to 6G are cross-section views similar to that of FIG. 3D, which are used to illustrate various embodiments of suspension members being used to hang a deck from a support beam, all according to the invention.

DETAILED DESCRIPTION OF THE INVENTION

The embodiments disclosed hereinbelow with reference to the drawing figures are best understood if preceded with a key to the reference numbers used in the description and related drawings. The key will then be supplemented by a general discussion of terminology and related concepts.

REFERENCE NUMBER KEY

Single Bridge (see FIGS. 2A-2B, 4A-4B) and Same Elements (Suffix x or y Added) in a Double Bridge (see FIGS. 1A-1B, 5A-5B)

100 bridge(structure) (x and y if doubled) {Aligned Support Bridge}
102 support beam (alt.=support, beam, arch)
103 beam ends (a=first, b=second)
104 suspension members (alt.=support members, cables)
105 deck
106 deck ends (a=first, b=second)
108 beam end foundation/abutment/base/ground reinforcement; may be combined with 109
109 deck end ground support/embankment/foundation/pad
110 support beam (lateral) centerline—longitudinally extending. May be approximated by a line of points midway between locations 114*a* and 114*b* where suspension members connect to the right and left sides of the support beam
112 support beam apex of curved shape (crossbeams 262 may cross between two apexes leaning on each other in a double bridge)
114 support beam connections (locations) for suspension members (alt. cable-beam connection)—(as shown in cross-section views, a=right hand one, and b=left)
115 deck apex of curved shape (265=crossover deck between two joined decks)
116 deck attachment points (a=right hand one, and b=left, center=c) for susp. members (alt. cable-deck attachment) (spaced apart distance La)
118 deck's lateral centerline midway between deck sides 120 (longitudinally extending)
120 deck's lateral sides (a=right hand one, and b=left)
122 support beam curved portion (alt. arc, arch)
125 deck's curved portion (alt. arc, arch)
128 spacer bar—positioned between suspension cables to spread them apart to improve parallelism of cables 104*a* to 104*b* between the beam and the deck
130 deck railing post/support
132 deck rail(ing) along sides 120 or moved a distance I toward center if necessary to protect users from hitting the cable when it angles across the deck Double Bridge Only

262 crossbeams, brace elements (joining doubled support beams)
265 deck crossover/midsection, portion of deck structure connecting doubled decks Other Elements

380 "ground"
382 public square/city block area left open by curved bridge design
384 river, street, etc. to bridge over
386 back spar means for helping to hold up a deeply curved support beam (instead of a massive foundation)
388 stay cables from back spar to support beam
390 spar foundation Dimension & Direction References (mostly shown in FIGS. 3A-3D)

HOR "level" plane relative to earth surface, defines global reference system in locale of bridge
VERT up/down, normal/perpendicular to horizontal plane, also defines global references
LT lateral=orthogonal to longitudinal line and in general plane of the curved deck or curved beam. Also, when considering the deck itself, lateral direction is generally in the plane of the deck. Since decks are usually held "level" across the width, then the lateral LT direction is equivalent to a direction within the HOR plane.
LG longitudinal=direction along a lengthwise average centerline that extends from end to end of an elongated object, in particular of deck or support beam. The LG direction changes wrt (with respect to) the global frame of reference since it follows the curvature of a curved object when considered in a restricted portion of the curved object. In a broader sense, the LG direction follows the large scale bends and curves while averaging out the small scale bumps and wiggles.
W deck width between laterally opposed sides 120 (in cross-section views, a=right hand one, and b=left)
La longitudinal distance between cable-deck attachment points
A1 average inclination angle of the deck wrt horizontal plane. Generally using a straight line extending from the lowest point (e.g., a deck end 106) to the highest point of the deck (e.g., deck apex 115). In a simple, non-limiting embodiment, the inclination line is approximately orthogonal to a line between the two deck ends 106.
A2 average inclination angle of the support beam wrt horizontal plane. Generally using a straight line extending from the lowest point (e.g., a beam end 103 at ground level) to the highest point of the beam (e.g., beam apex 112). In a simple, non-limiting embodiment the inclination line is approximately orthogonal to a line between the two beam ends 103.
A3 cable angle wrt vertical line at deck left side 120*b* (when left cable/suspension member 104*b* has attachment point 116*b* on deck left side 120*b*)
A4 cable angle wrt vertical line at deck right side 120*a* (when right cable/suspension member 104*a* has attachment point 116*a* on deck right side 120*a*)
F1 downward force on side of deck 120=half of total deck weight F2
F2 weight of a deck element (assumed uniformly distributed across width W of deck element to give a centered center of gravity). For calculations, one DECK ELEMENT is the deck-width W portion between 2 longitudinally adjacent deck attachment points 116 that are evenly spaced apart on both sides 120 of the deck. Idealized as a uniformly thick horizontal rectangular slab of width W and length La, and with one pair of suspension members (cables) 104*a*, 104*b* extending from the support beam 102 down to laterally opposed attachment points 116*a*, 116*b* that are centered in the length La of the deck element. The cable-beam connections 114*a*, 114*b* are assumed to be located above the attachment points 116 vertically wrt the longitudinal direction, so that the cable angles A3, A4 are confined to a single vertical-lateral plane that includes both beam connections 114 and both deck attachments 116.

F3 lateral force on left deck side 120*b* due to cable pulling at an angle A3 from vertical F4 lateral force on right deck side 120*a* due to cable pulling at an angle A4 from vertical H Height of concern about cable incursion. For pedestrian bridge assumed=6' tall person.

BH Beam 102 Height above deck 105

I incursion distance (dist. in from deck side 120 to location of cable at height H above deck)

OS offset of beam center 110 from deck center 118

NOTE: for beam 102 centered over deck 105 (beam centerline 110 vertically above deck centerline 118, so that offset OS=0), the following are true:

angle A3=A4 (symmetric on both sides 120*a*, 120*b* of deck), incursion distance I is same on both sides, lateral forces F3=F4 (balanced equal and opposite lateral forces=compression of deck between the attachment points 116*a*, 116*b*), and tension in the cable/suspension members 104*a*, 104*b* is equal and at the lowest possible magnitude. The weight of the deck F2 pulling against the cable tension does not cause any torque about the deck's longitudinal axis, or bending force on longitudinally adjacent deck elements.

OTHER GENERAL STATEMENTS AND TERMINOLOGY

Arch: This term is used loosely herein to mean a freeform curve that extends from deck/beam end 103/106 to deck/beam end 103/106 while undergoing a "U-turn" such that the two ends are roughly aligned to define a baseline, and the apex 112/115 represents the furthest perpendicular distance away from the baseline. Thus a shape disclosed as an "arch" may take the form of, but is not limited to, any regular shape like a parabola or catenary or semicircle.

Bridge: A structure 100 built to span physical obstacles for useful or aesthetic purposes such as a body of water, valley, road, or an interior floor/level of a building or structure, or beautiful scenery, for the purpose of providing passage, access, or useful or aesthetic purpose over the obstacle or useful or aesthetic purpose.

Support (beam)—used as a generic term for the upper bridge structure 102, which may also be defined to be an "arched shape", meaning generally curved but not limited to any particular structural profile like a parabola or circular arc, or ellipse etc. The curve doesn't even have to be smooth and regular, but should be close enough to allow for reasonable structural strength. In the present disclosure the curved support may generally be referred to as "the arch". The support 102 is alternately referred to as a support beam 102, or simply a beam 102, due to its relation to structural beams in construction.

Alignment—the deck 105 and beam 102 curves are said to be "aligned". The words horizontally, laterally, and vertically may be used to qualify this alignment, and all are intended to mean the same thing, i.e., in plan view (two dimensional), the curves appear to be horizontal and generally lateral to a longitudinal axis of the bridge, and/or to a baseline between bridge ends. In side elevation view, it can be seen that the arch 102 is above the deck 105, and in order to be horizontally aligned it must therefor be positioned directly above the deck, i.e., a vertical line will pass through both the deck and the arch—which we may therefor call "vertically aligned". As a result, the suspension members 104 will extend approximately vertically, thus vertically aligned (or having an approximately vertical orientation.)

Footer or Footing or Foundation—A structure 108, 109 that transfers loads to the earth.

Suspend—supported from above.

Suspension members 104 or support members or hangers or suspenders or suspending members are the same, i.e., connectors between the deck 105 and the supporting arch 102 above.

Cables or suspension cables are a common form of suspension members 104, so the terms may be used interchangeably herein for convenience.

Flexible or hinged joint - A flexible point of connection between two structures. May be used to damp vibrations, reduce rigidity of structure, and/or allow for thermal expansion and contraction.

Abutment or base or foundation - Part of a structure that supports the arch or the deck. Abutment 108, 109 may be, but is not necessarily, integrated with a footer. In this case (only to simplify descriptions) the footer and abutments may be thought of as integrated together as one. These are among a variety of terms used to describe what may be a fairly massive concrete object surrounding a beam end for the purpose of anchoring it to the surrounding ground and/or superstructure. This anchoring may include preventing a tilted support beam from reclining toward ground, especially while it is under loads due to supporting a suspended deck.

Further characteristics may include:

1. Arch footers and deck footers generally will not be located on or generally near or in the general vicinity of the longitudinal and lateral axes of the Aligned Support Bridge 100. This eliminates interference with any accessways, circulation routes, or any objects which may be positioned along or near the axes, such as a roadway intersection as an example. However, for a deck 105 with a very slight horizontal curve, it is possible part of the footing 108 or foundation 109 may overlap onto or cross over the axis.

2. The Aligned Support Bridge 100 enables the suspension members 104 or hangers, in a fairly consistent or uniform manner, to be approximately vertically oriented between the supporting arch 102 and corresponding horizontally curving deck 105 below, generally along the entire length or most of the length of the horizontally curving deck 105 if so desired.

3. With the structural arch support 102 options available, the Aligned Support Bridge 100 allows a fairly consistent vertical/lateral or approximately vertical/lateral alignment between the support arch 102 and the corresponding deck 105 below, to be maintained regardless of the degree of horizontal curvature to the deck 105, generally along the entire length or most of the length of the horizontally curving deck 105 if so desired.

4. Abutments underneath the horizontally curving decks 105 are not necessary.

5. As an option: Bracing 262 between double arches 102*x*, 102*y*, 112*x*, 112*y* can be added for additional support of the arches. (See FIGS. 1A-1B.) Braces 262 can be located at the apex 112*x*, 112*y* (and/or) further down along the sides of the arch 102*x*, 102*y* - located further down as long as the braces 262 do not interfere with users of bridge 100 or other potential uses or the deck 105 itself.

6. Decks 105 do not have to be inclined to make the invention work (though definitely preferred) or as an essential part of the invention (say crossing a river—compare FIG. 2B with FIG. 4B). However, in vast majority of all cases they will be inclined (or even declined like a light footbridge over a river), and this is pretty standard (inclined) for bridges, which generally makes the deck 105 more stable and possibly damps vibrations.

7. Option with double bridge (FIG. 1A): Decks are connected and braced against each other 265 for added stiffness and stability, and may allow users to crossover.

8. An advantage of suspending the deck 105 rather than supporting from below is that the deck 105 can be of more structurally simple and thinner construction which can be a significant advantage at times.

9. With the various additional support options available such as the back spar 386 (e.g., FIGS. 4A-4B) or the back arch, there is no lower limit to the arch's angle of inclination A2 as long as it doesn't interfere with the deck 105 or users or features on the deck 105.

10. The arch 102 is preferably in a single plane.

Double (Paired) Aligned Support Bridge(s)

The Double Aligned Support Bridge 100 is comprised of:

A pair of structurally stable arches 102*x*, 102*y* comprising of structurally stable materials, the pair of arches 102*x*, 102*y* lean inward toward each other and meet or are connected to one-another roughly around their central apex 112*x*, 112*y* as necessary with adequate bracing 103 for lateral stability and support of one-another. The inter-arch bracing 103 may continue down the side legs of the paired arches as far as needed to support and stabilize the two arches.

Each arch 102*x*, 102*y* is laterally aligned with a structurally stable laterally curving, crescent shaped deck 105*x*, 105*y*, respectively, there beneath. Suspension members 104 (e.g., cables, rods, etc.) extend downward, substantially vertically, to support each deck from each arch. The arches 102*x*, 102*y* with their aligned decks 105*x*, 105*y* approximately directly below, extend along either side of the longitudinal centerline of the bridge 100. The arches 102*x*, 102*y* with their aligned decks are approximately symmetrically disposed about the longitudinal axis of the bridge 100.

The decks 105 bow inward toward one-another and the longitudinal axis, and are connected to one-another generally around their central lateral apex 115*x*, 115*y* and are adequately braced 106 against one-another for added lateral, vertical, and torsional stability and support of one-another. Pedestrian accessways between decks 105*x*, 105*y* may be incorporated with the bracing 106 between the decks. The decks 105x, 105y may be slightly inclined toward one-another. Another option is the elimination of any connection or bracing between the two decks 105*x*, 105*y* resulting in the decks being isolated from one-another.

Notes:

Aligned Support Bridge 100 option regarding adding structural bracing or support between the arches 102*x*, 102*y*: The weight of the inclined arches and the corresponding supported decks is used to help "naturally" press the arches together and add stability to the entire arch structure through their connection and/or additional bracing. As another option, the arches 102x, 102y can actually meet and connect near or at their apex to add structural support and bracing of one-another.

Aligned Support Bridge 100 option regarding adding structural bracing or support between the arches 102*x*, 102*y*: Additional info—bracing between the arches can also be added below the decks 105*x*, 105*y* as long as the bracing does not interfere with the deck itself or any potential uses, users, or objects below the deck. E.g., such as a surface roadway 384 or a buried tunnel.

Aligned Support Bridge 100 options regarding adding structural bracing or support between the decks 105*x*, 105*y*: Additional info—bracing between the decks can also be added near their lateral and vertical apex or further away from the apex approaching the bases of the decks, as long as the bracing does not interfere with any potential uses, users, or objects, such, as for example, a surface roadway, sidewalk, pedestrians, cars, etc.

As another option, the decks 105*x*, 105*y* can actually (meet) and connect near or at their lateral and/or vertical apex to add structural support and bracing of one-another.

User access-way between the decks 265 can be an additional option either incorporated with or without the structural bracing and support between the decks.

As another option, the decks 105*x*, 105*y* may be hung, to a narrow degree off the vertical such that they press against each other adding stability to one-another through their connection and/or bracing.

Aligned Support Bridge 100 option regarding support/suspension members 104: The suspending/support members 104 located along the deck 105 can be in pairs along either side of the deck 105 as shown in the drawings or in a singular row along the deck middle as another option.

Paired Inclined Arches with Paired Crescent Decks—a Stable Pyramidal Form and Natural Damping Effects:

The arches 102*x*, 102*y* lean inward oppositely against each other and lock together partially from their own weight and the weight of the decks 105*x*, 105*y* thereby increasing stability. The arches 102*x*, 102*y* are structurally stable and stiff enough to handle these additional stresses. This pyramidal structure also has natural damping effects on vibrations. The two crescent decks 105*x*, 105*y* attached around their lateral apex 115*x*, 115*y* or mid area creates a stable layout for the decking. The four bases of the two decks 105*x*, 105*y* are widely splayed out from one-another and add stability to the overall deck layout through their connection at their central mid area. Each deck 105*x* acts to stiffen and stabilize the other deck 105*y* through their connection at the exposed mid area. This further decreases stress on the suspending arches 102*x*, 102*y*. The inclined arches 102*x*, 102*y* together with the suspended/supported decks 105*x*, 105*y* below, creates a very stable pyramidal shaped structure.

Live loads on the decks 105*x*, 105*y* below further stabilizes, and locks the arches 102*x*, 102*y* together. Additionally, any forces such as wind, acting on the arches from any direction, are met with an opposite force from the arches 102*x*, 102*y* themselves due to their pyramidal structure and inward lean from all sides and wide splayed out bases. The arches and/or the decks are connected to one-another by structurally stable connections. See "30 Bridges" by Matthew Wells, 2002, page 59, Campo Volantin Footbridge.

Paired Inclined Arches with Paired Crescent Decks—Overall Concept, Cost, Materials, and Arch Type:

The Aligned Support Bridge 100 is an overall bridge-type structural concept/design. The Aligned Support Bridge 100 does not consist of individually detailed structural parts. The Aligned Support Bridge 100 consists of several significant structural components all working in unison to formulate the overall Aligned Support Bridge 100 concept/design. The Aligned Support Bridge 100 is structurally simple and very stable and performs the function of two bridge type structures. Cost-wise the Aligned Support Bridge 100 could probably be built for a fraction of the cost of many of the prior art examples. Prior art examples with horizontally curving decks have a strong emphasis on beauty, at the expense of some practical and structural efficiencies. Every significant physical and structural aspect of the Aligned Support Bridge 100 was specifically conceived to solve a real life connectivity or circulation conflict.

The arches 102*x*, 102*y* could be constructed as a trussed arch, stressed arch, tubular arch, reinforced plated arch, composite, in combination of the above, or constructed by any other appropriate structurally stable means.

The arch bases 108 are constructed adequately to structurally stabilize the arches 102*x*, 102*y* and the bridge structure 100. The deck bases 108 are constructed adequately to structurally stabilize the four deck ends 106*ax*, 106*ay* and 106*bx*, 106*by*.

The decks 105*x*, 105*y* could be constructed as trussed, beams & joists, reinforced slabs, reinforced plated, stressed beams or slabs, composite, thin boxed or tubular, in combination of the above, or constructed by any other appropriate structurally stable means.

The Aligned Support Bridge 100 decks 105*x*, 105*y*, arches 102*x*, 102*y*, bases 108, and connections 114, could be made of or in combination of steel, reinforced concrete, composite, or other appropriate structurally stable materials.

The suspenders/suspension members 104 could be flexible cables, stiff hangers, rods, bars, reinforced arms, or other appropriate stable suspending type members, and made of steel, composite, or other appropriate structurally stable materials.

Paired Inclined Arches Supporting (Suspending) Paired Crescent Decks; Vertically Suspended Decks & Effects on Arch, Deck & Foundations—New Features & Benefits Relating to:

If a light source is held directly above each of the inward leaning arches 102*x*, 102*y*, the corresponding shadow cast beneath each of the arches 102*x*, 102*y* is in the shape of a crescent, creating a surprising result. With the alignment of the arches and their corresponding crescent shaped decks below, the crescent shaped shadows fall directly onto or approximately onto, or is approximately in alignment with the corresponding crescent shaped deck 105*x*, 105*y* below. The shadows correspondingly approximately represent where the suspenders or suspension members 104 would directly hang below the arch 102.

The arch 102 of the Aligned Support Bridge 100 can be inclined A2 to closely align the arch 102 vertically above the deck 105, allowing the deck 105 to be suspended more directly below the arch 102.

The Aligned Support Bridge 100 has the ability to maintain a consistent vertical or near vertical alignment between the deck 105 and the supporting arch 102 above regardless of the desired degree of horizontal curvature to the deck 105.

The Aligned Support Bridge 100 allows for the horizontally curving decks 105*x*, 105*y* to be more purely suspended from the arches 102*x*, 102*y* directly above with less inclination A3, A4 of the suspension members 104. The greater the angle off the vertical the suspension members 104 are, the greater the compressional, torsional, lateral, and buckling stresses are exerted on the decks 105*x*, 105*y*. The Aligned Support Bridge 100 can accommodate decks with significant horizontal curvature without significantly increasing the stresses on the decks by maintaining a relatively close-to-vertical suspension member 104 arrangement between the arch 102 and the deck 105.

Suspending straight decks, directly from above, is a common feature among bridges. However, this is a new feature of the Aligned Support Bridge 100 for laterally curving decks. Usually, laterally curving decks require supports or foundations directly below the deck or are suspended and/or supported by some form of cantilevering, gravity type, balancing or counter balancing means, which may require more expensive, more complicated, and/or extensive foundations and/or more structurally rigid decks and/or arches to counteract the additional torsional, compressional, and lateral forces created by both dead and live loads (such as wind). Cable stayed bridges with either straight or horizontally curved decks, produces decks under compression as a result of the inclined arrangement of the cables under tension which requires the decks to be more rigid to reduce the potential for buckling, overturning, and twisting.

See Glasgow Bridge by Richard Rogers Partnership/WS Atkins for Glasgow Competition.

See "30 Bridges" by Matthew Wells, 2002, pages 180-181, Gateshead Millennium Bridge.

See "30 Bridges" by Matthew Wells, 2002, pages 58-61, diagram on page 59, Campo Volantin Footbridge. The above three laterally curving deck examples must withstand compression, torsional forces, and buckling. The high degree of inclination of the cable stays and high degree of curvature of the deck require a stronger and stiffer deck. In the case of the Glasgow Bridge, the low angled arch necessitated a curved deck with highly inclined cable stays which are counterbalanced by the required "back" main cable and stays pulling oppositely on the arch from that of the deck stays. The "back" main cable and stays also keep the arch in compression. The Glasgow Bridge Deck is also cantilevered from the inner side requiring additional stiffness to the deck.

The Aligned Support Bridge 100, with the more or less vertical arrangement of the suspension members 104 between the arches 102*x*, 102*y* and the corresponding decks 105*x*, 105*y* below, torsional, compressional, lateral, and buckling forces are reduced, and thereby potentially simplifying and/or reducing the structural requirements, expense and/or massiveness of the decks and foundations. Also, in some locations depending on the depth and type of bedrock and/or existing soil conditions it may not be possible or practical to have massive or extensive foundations or anchorages that may be required for large cantilevered structures, structures requiring balancing, counterbalancing, or suspension type structures such as the Golden Gate Bridge.

Similarly to suspension bridges, due to flexibility in suspension, the Aligned Support Bridge 100 is less susceptible to earthquakes compared to stiffer cable stayed bridges where the decks are under compression. However, the Aligned Support Bridge 100 is more rigid than a suspension bridge which requires flexible hanger cables suspended from two flexible main cables. Therefore the Aligned Support Bridge 100 is less susceptible to wind forces and ever changing uneven live loads. The Aligned Support Bridge 100 has some rigidity characteristics of a straight "through arch bridge".

Additionally the Aligned Support Bridge 100, with the more or less vertical arrangement of the suspension members 104 between the arches 102*x*, 102*y* and the corresponding decks 105*x*, 105*y* below, the decks themselves as well as their suspension members potentially can be structurally simplified or reduced since the decks are not generally cantilevered, balanced or counter balanced, thereby potentially saving on expense. i.e., a cantilevered deck must have a certain degree of structural rigidity to be suspended or transfixed in space, and must to some (greater) extent be able to support part of its own weight and/or structure, as opposed to a deck that is more/or less hung vertically from above.

The above subject matters are presented in more detail below.

Usefulness of the Aligned Support Bridge Compared to Cable-Stayed Bridges and Suspension Bridges (Additional Details):

Cable-stayed bridge comparison: A cable-stayed deck is in compression, pulled toward the towers, and must be stiff against buckling at all times during construction and use. The decks 105*x*, 105*y* of the Aligned Support Bridge 100 generally just hang from suspenders 104 or support members and generally must just resist bending and torsion resulting from live loads and aerodynamic forces.

The Aligned Support Bridge 100 is not a rigid bridge and is able to withstand seismic movements better than heavier more rigid bridges such as cable-stayed bridges.

Suspension bridge comparison: Steel cables and wires need to be strung out the entire length of the suspension bridge. This is not the case with the Aligned Support Bridge 100.

A suspension bridge deck is extremely flexible due to the flexibility of the suspenders which are suspended from flexible main cables. Extra measures must be taken to stiffen the decks as a result.

The end anchors for a suspension bridge must withstand the tension of the main cables and are often considerably massive. The arch bases 108 for the Aligned Support Bridge 100 must only support the weight of the arch 102*x*, 102*y*, decks 105*x*, 105*y* and the live loads, and resist the further splaying out of the arch legs due to the arches pyramidal form. The further splaying out of the arch legs can be eliminated by structurally stable tie beams or other means.

The following discussion concerns a useful variation of the inventive Aligned Support Bridge 100 concept wherein a pair of Aligned Support Bridges are combined as shown in FIG. 1A. The pairing provides added benefits.

Inclination of Arch in Relation to Range of Lateral Curvature of Deck—New Features, Benefits Relating to:

The Aligned Support Bridge 100 offers wider ranging options for the horizontal (lateral) curvature of the deck 105, while maintaining vertical or near vertical suspension of the deck 105. The decks can be constructed with a greater degree of lateral curvature, than what might be possible, practical, or structurally or financially feasible with other bridge types. E.g., for the Aligned Support Bridge 100, a deck with a higher degree of lateral curvature would be paired with a more highly inclined and/or taller (vertical height) arch 102 to maintain deck to arch alignment, and thus a vertical or near vertical suspension of the deck 105. A deck with a low degree of lateral curvature would pair with a more vertical and/or shorter (less vertical height) arch. The vertical or near vertical arrangement of the suspension members 104 (to purely or close to purely hang the decks from the arches) can be maintained despite the amount of horizontal curvature to the decks 105.

FIGS. 1A-1B show a first embodiment of the Aligned Support Bridge 100 (in a doubled or paired configuration), wherein the beam ends 103 are located within the bounds of the decks 105 (best seen in plan view of FIG. 2A). The beam ends 103 may penetrate through the decks 105 into the beam end foundations 108 in the ground 380 below. The beam ends 103 may be connected to the decks 105 or completely isolated from the decks.

FIGS. 2A-2B show an embodiment of the Aligned Support Bridge 100 in a single deck configuration. Since most if not all of the design factors for a single Aligned Support Bridge 100 apply correspondingly to each of the two aligned arch bridge portions 100*x*, 100*y* in a double bridge 100, much of the present description uses the single arch embodiment for simplification. The arch base 103 location can be varied somewhat to accommodate site limitations and/or appearance preferences, as long as the majority of the deck 105 portions needing support are vertically aligned with the arch 102. A schematic plan view of FIG. 2A illustrates this, showing arch 102 aligned on right and ending at 103*a*, but on the left end the beam 102 goes off center to offset location 103*b*. As shown in FIGS. 3A-3D, this results in a significant problem when the beam is down low, but if higher the cable angle A3 improves significantly. As shown in FIGS. 3C, 3D and 3B, the effect of raising the beam above the deck yields improved parallelism, particularly when, as shown, the beam 102 is aligned with the deck 105.

The amount of elevation angle A1 and A2 for the two curved forms is indicated in FIG. 2B.

The Aligned Support Bridge 100 has the ability to maintain a consistent vertical or near vertical alignment between the deck 105 and the supporting arch 102 above regardless of the desired degree of horizontal curvature to the deck 105. The Aligned Support Bridge 100 allows the lateral alignment (centerline 110 versus 118) between the arches and the decks to match up exactly, closely, or relatively closely, depending on varying in the desired configurations of the arches and decks as described earlier. This degree of vertical or lateral alignment directly affects the degree of vertical alignment of the support members between the decks and arches. The closer the decks 105 and arches 102 are aligned, the closer the support members 104 will be to vertical.

Figure 6A:
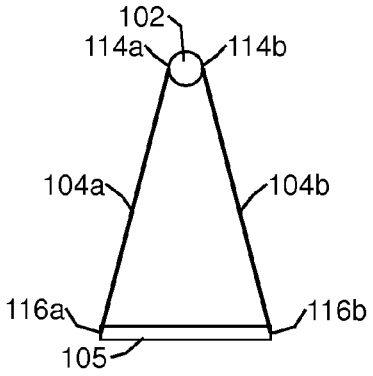
Figure 6B:
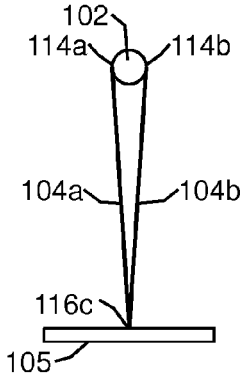
Figure 6C:
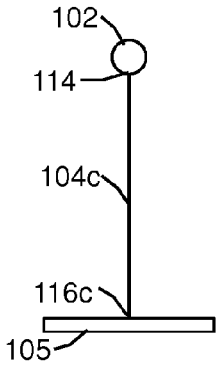
Figure 6D:
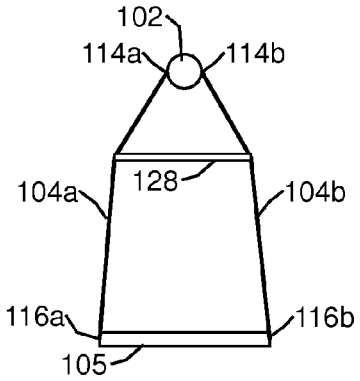
Figure 6E:
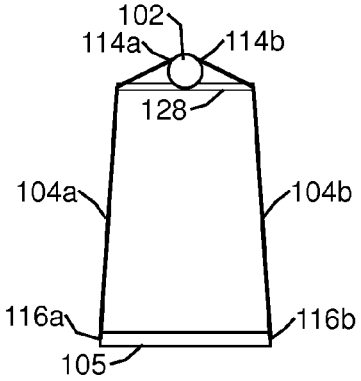
Figure 6F:
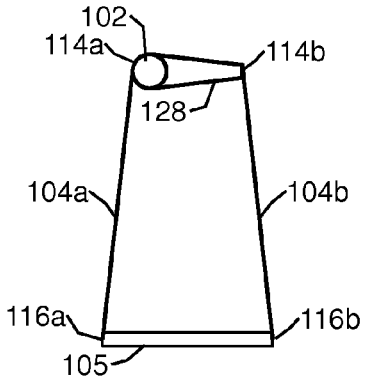
Figure 6G:
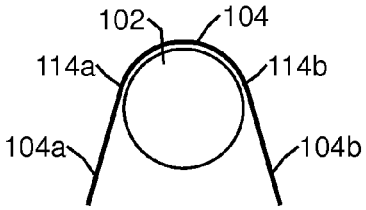

The suspending/support members 104, located along the deck 105, are generally in pairs coming down from both sides of the arch 102 as shown in FIGS. 6A-6B, 6D-6G, but optionally can be in a singular row along the deck 105 (FIGS. 6B-6C). In the latter case, the deck would have to be of stiffer construction to be structurally stable. There are ways to provide space between the suspension members 104, such as shown in FIGS. 6D-6F, wherein a spacer bar 128 is positioned to hold the suspension members apart.

Particularly referring to FIG. 3A, we can compare the effects of varying the beam height BH while maintaining the same cable angle on one side of the deck (A3 for left deck side 120*b*) as illustrated for beam locations labeled B(1), B(3), and B(4). We can also compare the effect of varying the lateral offset OS and letting the beam height BH be determined by limitations imposed on cable incursion distance I as illustrated for beam locations labeled B(1), and B(0).

The line 3A-3A indicated in FIGS. 2A and 2B show that the section view for FIG. 3A is taken close to shore where the support beam 102 is offset from the centerline 118 of the deck 105 and ends at offset location 103*b*. In FIG. 3A we see that this places the beam at B(0) which is laterally offset a distance OS(0) and at height BH(0) above deck 105. The support cables 104*a* and 104*b* are at cable angles A4(0) and A3(0), respectively. To establish an upper limit for the cable angles, we can look at cable 104*b* which angles across the deck such that it will interfere with passage for pedestrians of height H. If we decide that this incursion of usable space should extend across no more than half the deck width, that gives us an incursion distance I(0) as shown, where the cable 104*b* crosses the centerline 118 at the height H with a cable angle of A3(0). The cable angle A3=arctan(I/H). If the deck width W is 2H (12 feet), then I=H and A3=45 degrees. A more reasonable incursion I might be if the beam is at B(1), which has been positioned to illustrate the result of making the cable angle A3(1)=22 degrees. Now I(1) incursion is H tan(22)=2.4 feet if H is 6 feet, making this incursion 20% of the deck width W=12 feet.

Now we consider the effect of cable angle on the forces impinging on the deck 105. The greater these forces are, then the more robust the deck construction must be, which of course increases cost and also limits the artistic appearance possibilities. The deck is assumed uniform such that the weight F2 of a longitudinal section can be treated as weighing down the deck at the centerline 118. The suspension cables 104 must provide an equal amount of force F2 upward as a vertical component F1 of the tension on the cables, and F1=F2/2 since half the weight F2 is imposed on each side of the deck. Since the cables are at an angle, there is also a horizontal force component for each cable: F3 for the left cable 104*b* at angle A3 and F4 for the right cable 104*a* at angle A4. If the beam 102 is centered as in FIGS. 3B-3D, then A3=A4 and F3=F4 so the deck will be stable and only needs enough structural strengthening to bear a traffic load and resist the balanced compressive force F3=F4.

Comparing to this stasis situation to that for the beam at B(0), we see that the angle A3(0) is greatly increased and thus the horizontal force component F3(0) also greatly increases, in proportion to tan(A3)=F3/F1. Remembering that F1 is fixed at half the deck weight F2, and that A3(0) is 45 degrees, we can calculate that F3(0)=3.67×F3(1). To make matters worse, since A4(0) is switched in horizontal direction vs. A4(1), the horizontal component of tension in cable 104a now produces a force F4(0) to the right, same as the direction of F3(0). It can be determined that F4(0)=1.67×F3(1), therefore F3(0)+F4(0)=5.33×F3(1) all directed to the right (unbalanced force). In order to stay in place, the deck must be reinforced enough to resist this large unbalanced lateral force. Obviously offset distances and cable angles are to be minimized in order to use a light weight deck. The beauty of the Aligned Support Bridge 100 is that it is designed to make this minimizing of offset possible, no matter how much the deck is curved.

From the FIGS. 3A-3D we can also see that as beam height BH increases at minimal offset distance, then cable angles A3, A4 decrease and incursion distance also decreases (compare FIGS. 3B and 3D). FIGS. 3C and 3D illustrate placement of a railing 132 on posts 130. The left railing 130*b* in FIG. 3D has been placed at the incursion distance I, thereby preventing the human of height H from hitting his head on the support cable.

In FIG. 3A, the beam positions B1, B3, and B4 all have the same cable angle A3(1), so the force F3 is constant. The right side force F4 increases with beam height BH but not nearly as drastically as the increase for beam position B(0). Comparing B(0) to B(4) we see they are at the same offset distance OS(4)=OS(0), but the relative magnitude of the unbalanced force F4+F3 is decreased in proportion to the beam height BH which determines the cable angles A3 and A4.

In particular, angle A3(1) is 22 degrees, and A3(0) is 45 degrees as discussed above.

Paired Inclined Arches Supporting (Suspending) Paired Crescent Decks: Arch Bases/Foundations and Deck Bases/Foundations Located Away from Longitudinal and Lateral Axes—New Features, Benefits Relating to:

The structurally stable arch bases 108 and structurally stable deck bases 109 can be incorporated with one-another or separated from one-another. The arch bases 108 and deck bases 109 are located away from the longitudinal axis and lateral axis of the bridge. This may be advantageous such as bridging over a roadway intersection 384. This eliminates bridge obstructions beneath the entire general area below the decks, and anywhere in the general vicinity of the longitudinal or lateral axes of the bridge, and any roadways 384 over which the bridge 100 may be passing if used for such purposes.

Paired Inclined Arches Supporting (Suspending) Paired Crescent Decks: Application to Other Structures—New Features, Benefits Relating to:

The Aligned Support Bridge 100 does not necessarily apply to only bridges. The Aligned Support Bridge 100 can apply to buildings, stadiums, theaters, stages, and/or other types of structures, which may involve transport, circulation, avoiding obstructions and/or bypassing objects or problem conditions. The decks 105 may have other purposes or uses not related to transport or circulation.

Paired Crescent Decks Additional Details About Features, Benefits:

A. Low Arch and Pyramid—The laterally curving crescent shaped decks 105*x*, 105*y* may be inclined to some degree, reaching a high point approximately around the mid-section lateral apex 120, 115 of the decks, creating low-angled arches which are connected to and braced against one-another approximately in this mid-section area for added stiffness and a degree of lateral, vertical, and torsional stability and support of one-another. This deck configuration forms a low angled pyramid for a degree of lateral and torsional stability and structural support of one-another. The four widely splayed-out deck ends add lateral stability to the decks. Decks may be stressed or unstressed.

B. Connected Decks Damping Vibrations—The decks 105*x*, 105*y* are connected to one-another: This configuration stiffens the decks and also has a natural damping effect on bridge vibrations, since the decks 105*x*, 105*y* curve oppositely from one-another both horizontally and vertically. The dead loads of the decks 105*x*, 105*y* help to further dampen the transfer of vibrations from one deck to the other. As another option, the decks 105*x*, 105*y*, in addition to being connected to one-another, may lean oppositely against one-another to (some smaller) degree, creating greater lateral pressure against the decks 105*x*, 105*y* at their connection which adds some stability and stiffening to the decks 105*x*, 105*y* and may help to further dampen vibrations from one deck to the other. All these opposite configurations and forces may have a natural damping effect on vibrations. See Millennium Bridge by Foster and Partners—Anthony Caro/Ove Arup and Partners, "30 Bridges" by Matthew Wells, 2002, pages 88-89. Jointed or flexible connections between the decks further dampens vibrations.

A curved deck has general massings, beams and/or other connections with varying lengths, sizes, locations, and orientations due to the curvature of the deck 105. This variation has a damping effect against vibrations and harmonic flexing.

C. Connected Decks Stabilize Overall Bridge

The connection of one deck 105*x* to the other 105*y* helps to stabilize the decks 105*x*, 105*y* against forces (such as wind) laterally, torsionally, transversely, and vertically, also resulting in lessening the impact of such forces on the above supporting arches 102, the suspension members 104, the decks 105*x*, 105*y* themselves, the arch foundations 108, and deck foundations 109, thereby potentially reducing and/or simplifying each of the above's structural requirements, cost, and size.

D. Option: Connected Decks Lean Against One-Another Adding to Stability

In addition to the decks 105*x*, 105*y* being connected to one-another, in another option the decks 105*x*, 105*y* may lean inward against each other slightly to some degree which adds stiffness and helps to stabilize the decks 105*x*, 105*y* and dampen vibrations as stated earlier. This additional stabilizing effect on the decks 105$x$, 105$y$ results in less stress being transferred to the supporting arches 102, suspension/support members 104, decks 105, arch foundations 108, and deck foundations 109, thereby potentially reducing and/or simplifying each of the above's structural requirements, cost, and size.

E. Connecting Exposed Horizontally Curved Decks Adds Stability

Since the crescent deck mid areas 115 protrude laterally in an exposed manner, and are also the furthest from each of the deck's foundations 109 on either end, the decks' mid areas 115 are more susceptible to forces such as wind deflection and resulting vibrations. The deck to deck connections and bracings 265 help to stabilize the decks 105$x$, 105$y$ against forces such as wind, which results in lessening the impact of these forces on the above supporting arches 102, suspension/support members 104, decks 105, arch foundations 108, and deck foundations 109, thereby potentially reducing and/or simplifying the bridge's structural requirements, cost, and size.

F. Option: The Decks are not Connected

Connection and bracing 265 between decks 105$x$ and 105$y$ are eliminated. The decks are isolated from one-another. The decks in this case are constructed structurally stable with greater horizontal stiffness, possibly more weight, and with greater torsional resistance, which is structurally possible. The Gateshead Millennium Bridge is an example of a single deck with a high degree of curvature built with great stiffness. The deck and arch actually rotate up in the air so the cables are parallel to the ground. See "30 Bridges" by Matthew Wells, 2002, pages 180-183, Gateshead Millennium Bridge. The Chords Bridge, Jerusalem, by Santiago Calatrava, is another example. These bridge deck examples must deal with much greater compressional, torsional, and buckling forces than the Aligned Support Bridge 100.

G. Pyramidal Form of the Aligned Support Bridge Plus Live Loads Increases Stability Due to the arrangement of the arches 102 and decks 105$x$, 105$y$ all leaning inward toward one-another like a pyramid and toward the center of the bridge 100, applied loads on the decks 105$x$, 105$y$ lock the bridge system tighter together and increase its stability.

Prior Art (Summary and Comparison of Different Examples and Advantages of the Aligned Support Bridge)

(Regarding: Counter-Balancing Horizontally Curving Decks):

Bridges with horizontally curving decks (supported from above), usually are supported by arches or spars arranged to counter-balance the weight of the deck by leaning away from the deck resulting in sharply angled cables, and often cantilevered decks. Cantilevered decks are required to be stiffer to support their own weight. The effects of counter-balancing or leaning oppositely from one-another produces significant, additional compressional stress, torsional stress, and buckling stress, on the deck and sometimes on the arch, with additional stress on the foundations as well in comparison to the Aligned Support Bridge 100. The additional stress requires a structurally stiffer deck. One drawback to steeply inclined cables or stays is that they can interfere with pedestrian headroom or other bridge parts. This is probably one reason why bridges with a high degree of deck curvature have cables or stays only on the side of the deck closest to the arch and require cantilevering the deck. Additionally, more massive and/or more complex foundations may be required for balanced structures in order to counteract live loads such as wind which can be significant.

The decks 105$x$, 105$y$ of the Aligned Support Bridge 100 generally just hang from the arches 102$x$, 102$y$ with the suspension members 104 in a more vertical arrangement, removing all or most interference with users of the bridge 100. This vertical arrangement of suspenders 104 is possible with the Aligned Support Bridge 100 because the arch leans toward and over the deck 105 rather than oppositely from the deck 105 it supports.

If a paired combination of Aligned Support Bridges 100 is utilized, then counter-balancing is not necessary because of the very stable pyramidal arrangement of the overall arch structure (two arches leaning against each other). In fact the significant stability and arrangement of the Paired Aligned Support Bridge 100 allows some flexibility to set the degree of inclination, size, shape, and weight of the arch 102, in order to maintain the suspenders or support members 104 in a more vertical position between the deck 105 and the arch 102. The specific shape, size, location, and weight of the deck 105 can be adjusted to some degree as well for added flexibility or to relieve some stresses on the arch 102. Comparatively, there is much less flexibility in adjusting the physical characteristics and arrangement of a deck and an arch that work in unison to counter-balance each other, since changing the characteristics of one will generally directly impact the other.

Generally, bridges with horizontally curving decks (supported from above) have decks with a very low degree of horizontal curvature and deviate very little from the longitudinal axis of the bridge for purposes of stability. Increasing the degree of horizontal curvature to the deck generally results in increasing compressional, torsional, and buckling stresses, and may also result in a cantilevered deck. Examples of bridges supporting decks from above with a high degree of horizontal deck curvature (few were found) are described in more detail elsewhere in the present disclosure—the Glasgow Bridge and the Gateshead Millennium Bridge. These two prior art bridge examples were the only ones discovered where the arch leaned toward the deck it was supporting. By the arches leaning toward the decks, additional support structures are needed to stabilize the structure for these two examples. All of the prior art examples mentioned above incorporate some form of counter-balancing, and have cantilevered decks under compression which exposes some of the uniqueness of the Aligned Support Bridge 100. An exception is the Main Street Bridge in which the deck does not appear to be under compression, but instead it requires massive support beams.

Prior Art (Summary and Comparison of Different Examples and Advantages of the Aligned Support Bridge) (Regarding: Compression; Torsion; Buckling; Cantilevering; Counterbalancing; Low Degree of Lateral Curvature; Aligned Along the Longitudinal Axis; Additional Cables, Cost):

The below three prior art examples, with horizontally curving decks, have deck stays or supports attached at the vertical side of the deck or below the deck. The decks are actually cantilevered from the side. The Glasgow Bridge and Gateshead Millennium Bridge function with their decks under compression.

Characteristics of the Main Street Bridge: The laterally curving pedestrian deck is supported from below and is cantilevered. The pedestrian deck and the inclined arch together appear to counterbalance the vehicular deck. Very massive structural support (large beams) underneath the deck is required. The deck has a low degree of lateral curvature. The bridge support bases are directly aligned along the longitudinal axis of the bridge. The bridge cost $60 million.

Characteristics of the Glasgow Bridge: The stays (angled cables) on either side of compression arch counter-balance each other. The deck could not "hang" vertically from the arch (like the Aligned Support Bridge 100) because this would cause the arch to be unstable, due to the resulting lack of tension (pulling forward) from cables on deck side of the arch balancing out tension from cables on the opposite side of the arch (pulling back). That is, the deck side cables pull the arch forward and downward and out of compression and the back side cables pull the arch back and slightly upward, thereby balancing each other out and keeping the arch more rigid. In this case the steep angle off vertical of the deck-side cables is very important to the overall stability and balance of the arch and structure. In addition the arch requires an additional pair of braces on the deck side. The Glasgow Bridge arch is under more complicated stresses than the Aligned Support Bridge 100. The Glasgow Bridge requires an additional very long back cable to give the arch "lift" from above and keep it from falling flat to the ground. The back cable also maintains the arch in compression and balances the tension from the deck side stays as stated earlier. The deck is in compression and is cantilevered. The foundations of both the arch and back cable are connected as one piece for stability and mass. The foundations are massive and more complicated due to both the arch and deck, counter-intuitively, leaning toward the same side, rather than leaning in opposite directions to balance each other out. An attractive, but not very efficient structure.

Glasgow Bridge by Richard Rogers Partnership/WS Atkins for Glasgow Competition.

Gateshead Millennium Bridge by WilkinsonEyre Architects/Gifford and Partners, "30 Bridges" by Matthew Wells, 2002, pages 180-185.

Main Street Bridge, Columbus, Ohio, by Spiro N. Pollalis and DLZ.

The below prior art example, Campo Volantin Footbridge, has only a very slight horizontally curved, almost straight deck, similar to the vast majority of bridges with curved decks supported from above. The vast majority of these bridges are limited to decks with only a slight horizontal curve, deviating only slightly from the longitudinal axis of the bridge for of stability. The greater the horizontal curve, the stiffer the deck must be built to counter increasing compressional and torsional forces, and greater potential for buckling. The Campo Volantin Footbridge deck is under compression.

The Campo Volantin Footbridge deck is very close to being a straight deck in plan view. Functionally, a straight bridge would work just as well and more efficiently in this case (though probably not as attractive). The Arch is inclined away from the deck to counterbalance and counteract the weight of the deck. See "30 Bridges" by Matthew Wells, 2002, Campo Volantin Footbridge, 58-59.

Because of the steep inclination of the cables on the Campo Volantin Footbridge, outriggers for the cables are required on the outer side of the deck to allow headroom beneath the cables.

Bridge supports and foundations must also maintain the stability of a balanced structure against lateral and torsional forces such as wind. The Aligned Support Bridge 100 has more flexibility, in that the weight distribution between the arches 102 and decks 105 must not necessarily be balanced.

See Campo Volantin Footbridge by Santiago Calatrava, "30 Bridges" by Matthew Wells, 2002, page 58-63. Regarding the prior art of the Weser River Pedestrian Bridge and the Nesciobrug Bridge:

Two prior art bridges have decks with a slight horizontal curve which are hung by somewhat vertical cables. Both are supported by two spars. The disadvantage of these bridges is that the degree of horizontal deck curvature is limited by the (horizontally) straight main support cable connecting the two spars. This main cable must remain horizontally straight or very close to straight, and the individual supporting cables must be more or less vertically in line with this main cable above. Therefore the deck below cannot deviate far from this horizontal straight line between the spars.

Also the Nesciobrug Bridge deck is of deep "box" girder-like construction for significant stiffness.

Prior art shows bridges with the decks hung from two poles. Photos showing the curving decks are actually very deceiving, since in actuality the decks are almost straight with an extremely slight curve limited by being suspended by 2 poles. The curve is slight, but they are important because they show the limitations of the prior art techniques.

Novelty of Aligned Support Bridge (Ability to Connect 3 or More Areas):

Referring especially to FIGS. 1A-1B: the Aligned Support Bridge 100 does the work of two or more bridges by connecting two, three, four or possibly more separate areas, or four city blocks 382. The Aligned Support Bridge 100 potentially can connect three, four, or more widely separated areas 382.

Usefulness of Aligned Support Bridge Relating to an Urban Infrastructure:

In urban areas where space is at a premium and is often limited or restrictive, the configuration of the horizontally curving decks 105*x*, 105*y* has the ability to curve around the periphery of a city block 382, or area, giving added length to the deck pathway (to rise vertically) before spanning over a road 384 or intersection. The added length allows the deck 105 to meet both the minimum vertical road clearance required beneath the deck (e.g., Ohio Department of Transportation, ODOT, 17.5° for a pedestrian bridge) and the maximum allowable slope for an accessible (disability) pedestrian pathway (12:1, length:height) as required by federal and state accessibility codes.

In order to meet federal pedestrian accessibility (disability) standards, the 12:1 allowable maximum slope for a pathway, plus a required 5' flat (resting) landing for every 30 linear feet of ramp creates an extremely long ramp to meet the required DOT minimum vertical road clearance. For example in Ohio, MVRC is 17.5° plus the thickness of the deck/ramp (say 2.5°) equals a 20' high deck surface above the road. Therefore, curving the deck surface 105 around the periphery of a city block 382 is a necessity for added length while allowing the central portion of the block available for buildings or other uses. Because the decks of the Aligned Support Bridge 100 are generally hung from the arches 102, they can be structurally simple and therefore thin, allowing for a reduced deck surface height above the roadway 384, which can be important in a restricted urban setting.

A 20' minimum vertical clearance requires: 240 LF of ramp+45 LF of flat landings=285 LF of total deck length before the ramp/deck could begin crossing over the roadway 384 beneath. The ramp/deck would have to begin crossing over the roadway 384 well before the intersection in order to maintain a relatively uniform horizontal curve to the ramp/deck 105. In addition, the ramp would need to start inside the sidewalk away from the street. There are other variables but this clearly shows the necessity for a long ramp.

Additionally, by curving around the periphery of a city block 382, this leaves the majority of the block, including the more central areas of the block open, undivided, unhindered and available for other uses such as buildings, structures, monuments, and parks. With the bridge structure 100 located around the periphery of the block and above the roadway 384, this creates more free air space directly above the block and therefore allows for more available sunlight, especially in an urban area with tall buildings where sunlight is at a premium. Some cities have codes restricting new construction from blocking the sunlight of neighboring users. Also, by suspending the decks 105*x*, 105*y* from above this leaves more valuable urban space below the decks 105*x*, 105*y* available for other uses. Additionally, the portion of the deck 105 above the roadway 384, creates additional usable space.

The Aligned Support Bridge 100, when doubled/paired, has the ability to connect four±city blocks 382 and widely spaced areas with one single structure increasing greatly the walkability and connectivity of cities for pedestrians, which is a significant growing movement in cities across the country. See below example for Cleveland Public Square from which the Aligned Support Bridge 100 concept evolved (FIGS. 1-6, especially FIG. 1).

Arches 102*x* and 102*y* generally occupy the same or similar vertical space above decks 105*x* and 105*y* they are supporting respectively, thereby leaving more useable surrounding space for buildings, structures or other uses. The Gates Millenium Bridge and the Glasgow Bridge take up much more horizontal space in plan view, and would potentially interfere with roadways as well, due to long supporting cable tails, leaving much less space for other structures.

See Glasgow Bridge by Richard Rogers Partnership/WS Atkins for Glasgow Competition.

See Gateshead Millennium Bridge by WilkinsonEyre Architects/Gifford and Partners, "30 Bridges" by Matthew Wells, 2002, pages 180-185.

Usefulness of the Aligned Support Bridge in an Urban Area:

The Aligned Support Bridge 100 is useful at road intersections and also possibly anywhere where there is a desire to connect multiple (2 or more) widely separated spaces by spanning over obstacles, intersecting traffic, circulation, transportation and/or navigation routes or any other conflicting uses. The Aligned Support Bridge 100 invention also has potential significant value in urban, suburban, public squares, central park spaces, generally congested or highly concentrated and/or populated areas, etc., where there is a desire to connect pedestrian oriented spaces, and/or where generally buildings, structures, art pieces, and/or monuments occupy the central portions of city blocks.

In the United States and other countries, there is a major movement in urban areas to create and connect pedestrian passages and "green" spaces thereby creating a more "livable" environment, and decrease the effects of an auto dominated environment. In some cities, streets have been closed down all together and converted into pedestrian parks, outdoor malls, auto-free pedestrian connectors, etc. Often this increases auto traffic congestion in an already congested urban core, and gives yet another reason for people not wanting to drive downtown at a time when public officials and citizens are trying to revitalize the urban core and attract more people into a deteriorating downtown area. The Aligned Support Bridge 100 has the ability to connect four±city blocks for pedestrian use without restricting vehicular traffic what-soever, while leaving the central block spaces available for other uses. The bridge invention also has the potential to create a central signature landmark for a city or town, as well as become an attractive destination source in itself, drawing people to, and helping to revitalize the city core. See the description of Cleveland Public Square in the Aligned Support Bridge 100 description.

In some cities, the major public spaces or squares are divided by wide busy intersections. This is yet, another example where the Aligned Support Bridge 100 may be useful.

Many city blocks are often divided by busy, very wide, multi-lane intersections, which can be a deterrent for the elderly or for the physically impaired. This is another example where the Aligned Support Bridge 100 can prove useful.

Exacerbated by the economy, many urban areas beyond the city core have deteriorated with vacant, abandoned, razed buildings, and/or condemned buildings, opening up city blocks for other uses. The Aligned Support Bridge 100 has the ability to connect these areas as well for pedestrian use without disrupting vehicular traffic. A strategically located attractive signature bridge has the potential to become a catalyst for revitalized growth in a rebounding urban district or a district under reconstruction.

Prior Art (Comparison of Prior Art Example and Advantages of the Aligned Support Bridge) (Example Bridge Requires a Very Steep Deck):

Hacking Ferry Bridge by WilkinsonEyre Architects (concept thrust-arch tripod bridge). Requires steep legs for structural stability.

Arch rises (ht.)=8M

Leg of Arch (length)=43.5 M

8÷43.5=18.4% (1:5.44, height:length) average slope of pathway leg. Slope of the leg is much steeper at the base than at the top of the leg. Slope of the leg is much steeper than 18.4% at the base of the leg. This slope far exceeds federal (U.S.) accessible pathway slope requirements such as the United States Architectural and Transportation Barriers Compliance Board and Americans with Disabilities Act Accessibility Guidelines (ADAAG) which stipulates a maximum acceptable slope for an accessible pathway is 8.33% (1:12)

Novelty of Aligned Support Bridge—First Hung Curved Deck:

The Aligned Support Bridge 100 represents the first bridge with a significantly horizontally curved deck supported from above, where the deck does not require significant additional stiffness, torsional resistance, resistance to buckling, and/or handling of significant compressional forces that would result from the deck 105 being cantilevered, or under compression, or would result from the deck suspenders, stays, or support members 104 being positioned at a significant angle A3, A4 from the vertical that would require additional structural reinforcement of the deck 105 or arch 102 in comparison to the deck 105 of the Aligned Support Bridge 100 which generally is just hung or supported generally from directly above the deck 105 or from the general vicinity above the deck 105. The Aligned Support Bridge 100 represents the first bridge with a significantly horizontally curved deck 105 supported from above where more extensive structural stiffening or support is not required, since the decks of the Aligned Support Bridge 100 are generally just hung or supported generally from directly above or from the general vicinity above the deck 105.

Usefulness, of Bridge Invention (Cleveland Public Square):

Cleveland Public Square, Cleveland, Ohio, has many of the characteristics described above for an urban area, where the implementation of the Aligned Support Bridge 100 would be invaluable. Cleveland Public Square is in the city central business district and centrally located among major business, cultural, civic, neighborhood, and entertainment districts. Presently the four quadrants of Cleveland Public Square are divided by two very busy six-lane wide arterials intersecting at the center of the square, greatly limiting the square's use and pedestrian friendly access throughout the square and the center of the city. Project for Public Spaces, an organization that analyzes urban public spaces, ranked Cleveland Public Square as one of the worst usable public squares in the world.

The Aligned Support Bridge 100 would not only link up the four quadrants for pedestrians and users but would also serve as a major pedestrian corridor linking up a number of significant users and destination points on and surrounding Public Square, including the Warehouse District Neighborhood, the Euclid Avenue Health Line Corridor, East Forth Street Entertainment District, Gateway Sports Complex (home of the Cleveland Indians and Cavaliers), The Tower City Complex, Key Bank Building Headquarters, BP Building Headquarters (recently moved), The Civic Mall and Waterfront, potentially the Canal Corridor through the Tower City Complex, two potential major developments immediately NW of Public Square, and other significant developments. Cleveland Public Square is centrally located among all the above entities which are, for the most part, isolated from one-another.

For over 150 years, since 1852 (horse & buggy days) or earlier, there has been an ongoing major dispute in Cleveland between citizens who want to maintain the four Public Square quadrants separate to allow traffic to pass through unimpeded, and those that want to close off traffic through the Square and make Public Square one big green space. In 1856 the "Public Square Fence War" began with organized citizens and officials erecting a fence around all (4) quadrants to keep traffic out, "*The Heart of Cleveland, Public Square in the* 20$^{th}$ *Century*", by Gregory G. Deegan and James A. Toman, pp. 4-7. There has since been numerous designs and proposals by prominent architectural, engineering, and landscape architectural firms from around the country that have attempted to address this issue, "*The Heart of Cleveland, Public Square in the* 20$^{th}$ *Century*", pp. Introduction, 16, 22, 48, 54, 55, 87, 99, 100, other; *The Cleveland Plain Dealer, Metro B*1, Jun. 11, 2006. None of which have succeeded in satisfying both major interest groups. This problem remains to this day. There is a current proposal to install a giant earth mound or landscape berm over the entire square to allow vehicular traffic to tunnel underneath, while allowing the above mound for pedestrian use.

The reason for detailing out the past history and characteristics of Cleveland Public Square is to demonstrate the real life usefulness of the Aligned Support Bridge 100 to solve very old and significant problems that have never been resolved despite significant and numerous attempts over the past 150+ years.

Many cities struggle with similar problems to those mentioned above.

Novelty of Aligned Support Bridge—First Horizontally Curving Deck Suspended From Inclined Arch Located Substantially Directly Above the Deck:

Two important parts of the invention are:

1. The Aligned Support Bridge 100 is characterized by alignment of the lateral curve of the supporting inclined arch with the horizontal curve of the deck suspended therebelow in a stable fashion.

2. The Aligned Support Bridge 100 enables a near-vertical orientation of the suspension members that extend between the horizontally curving deck and the support arch above it.

Thus a horizontally curving deck is suspended from an inclined arch which is generally located directly above the deck or close to that, i.e., laterally (horizontally) aligned.

The paired Aligned Support Bridges 100 described hereinabove with reference to FIGS. 1-6 are disclosed as an embodiment that further improves the invention by providing a simple and elegant method for supporting and stabilizing the inclined arch of the bridge.

Nevertheless, the inventive Aligned Support Bridge 100 concept and design method can also be implemented as a single curved bridge that can be enabled by using a variety of known methods of strengthening the supporting arch. For example, the inclined arch supporting the horizontally curving deck below can be supported in turn by an oppositely leaning arch from behind, or by spars, cables, towers, counterbalancing structures, or by any other structurally adequate method available. An example of using a back spar 386 with foundation 390 and stay cables 388 is shown in FIGS. 4A-4B.

Bigger and thicker arch plating or extra internal bracing to the arch can be added to make arch stronger and stiffer. Another way to further structurally strengthen, stabilize and stiffen the Aligned Support Bridge's supporting arch 102 is to add underground tie-beams connecting the bases of the arch. For the double (paired) Aligned Support Bridge 100, all four bases 108 of the two arches 102 can be tied in a square pattern. Still another option is to add two tie beams connecting all four bases 108 in a crossed pattern. Still yet another option is to combine the two options above to super stabilize the bases 108 and arches 102. These examples show there are yet more ways to stabilize or further stabilize the arches 102 of the Aligned Support Bridge 100.

Although the invention has been illustrated and described in detail in the drawings and foregoing description, the same is to be considered as illustrative and not restrictive in character—it being understood that the embodiments shown and described have been selected as representative examples including presently preferred embodiments plus others indicative of the nature of changes and modifications that come within the spirit of the invention(s) being disclosed and within the scope of invention(s) as claimed in this and any other applications that incorporate relevant portions of the present disclosure for support of those claims. Undoubtedly, other "variations" based on the teachings set forth herein will occur to one having ordinary skill in the art to which the present invention most nearly pertains, and such variations are intended to be within the scope of the present disclosure and of any claims to invention supported by said disclosure.

What is claimed is:

1. A bridge structure comprising:

a laterally curved deck that is supportingly connected by substantially vertical suspension members to a laterally curved support beam thereabove, wherein:

the deck and the support beam are both curved between two respective ends, and have ground attachment contact only at their respective ends; and thereby using substantially vertical suspension members to minimize weight of the suspended deck by minimizing mechanical stresses imposed on it.

2. The bridge structure of claim 1, wherein:

the deck describes a mostly planar curved shape predominantly characterized by an arch having an apex between two deck ends distal to the apex, and its plane is generally inclined or declined at a first angle relative to horizontal, wherein the first angle can be positive, zero, or negative, with a magnitude less than 45 degrees; and the support beam describes a mostly planar curved shape predominantly characterized by an arch having an apex between two beam ends distal to the apex, and its plane is generally inclined or declined at a second angle relative to horizontal, the second angle being sufficient to position the support beam above the deck.

3. The bridge structure of claim 1, wherein:

a plurality of suspension members extend downward from support beam connections, which are longitudinally spaced apart along the support beam, to deck attachment points, which are longitudinally spaced apart along the deck.

4. The bridge structure of claim 3, wherein:

at least a portion of the deck attachment points are spaced apart along a center line of the deck.

5. The bridge structure of claim 3, wherein:

each deck attachment point comprises a pair of side attachment points near laterally opposed sides of the deck.

6. The bridge structure of claim 5, wherein:

two suspension members extend from a support beam connection to a pair of the laterally opposed side attachment points.

7. The bridge structure of claim 5, wherein:

a spacer bar is attached between two suspension members, thereby improving parallelism of the two suspension members therebelow.

8. The bridge structure of claim 1 wherein a plan view of the bridge structure shows that:

the support beam's curve substantially overlays and laterally aligns with a majority of the curved deck's length; and the ends of the support beam are structurally and supportingly fixed to ground at locations proximal to locations where the corresponding ends of the deck reach ground support.

9. The bridge structure of claim 1, wherein the deck is a first deck, the support beam is a first support beam, and the bridge structure further comprises:

a second laterally curved deck that is supportingly connected by substantially vertical suspension members to a second laterally curved support beam thereabove, wherein:

the second support beam leans against the first support beam; and the second deck and the second support beam are both curved between two respective ends, and have ground attachment contact only at their respective ends.

10. The bridge structure of claim 9, further comprising:

one or more brace elements attached between the first support beam and the second support beam, thereby enhancing mutual support of the first and second support beams.

11. The bridge structure of claim 10, wherein:

a laterally extending brace element establishes the leaning contact between the first and second support beams.

12. The bridge structure of claim 9, wherein:

the curved part of the first deck is laterally connected to the curved part of the second deck, thereby adding stiffness and stability.

13. The bridge structure of claim 9, further comprising:

a portion of deck structure connecting the first deck to the second deck for enabling passage from one deck to the other one of the first and second decks.

14. The bridge structure of claim 9, wherein:

the first and second decks each describe a mostly planar curved shape predominantly characterized by an arch having an apex between two deck ends distal to the apex, and the planes of the first and second decks are each generally inclined or declined at a respective first deck angle relative to horizontal and a respective second deck angle relative to horizontal, wherein the respective first and second deck angles can be independently valued at a positive, zero, or negative magnitude less than 45 degrees; and the first and second support beams each describe a mostly planar curved shape predominantly characterized by an arch having an apex between two beam ends distal to the apex, and the planes of the first and second support beams are each generally inclined or declined at a respective first or second support beam angle that is sufficient to position each of the first and second support beams above a corresponding first or second deck, respectively.

15. A bridge structure comprising:

a laterally curved first deck that is supportingly connected by substantially vertical suspension members to a laterally curved first support beam thereabove, wherein:

the first deck and its corresponding first support beam are arches each having an apex distal to and between two respective ground contacting ends;

a laterally curved second deck that is supportingly connected by substantially vertical suspension members to a laterally curved second support beam thereabove, wherein:

the second deck and its corresponding second support beam are arches each having an apex distal to and between two respective ground contacting ends; and the second support beam leans against the first support beam.

16. The bridge structure of claim 15, wherein a plan view of the bridge structure shows that:

the first support beam's arch substantially overlays and laterally aligns with a majority of the first deck's arch;

the second support beam's arch substantially overlays and laterally aligns with a majority of the second deck's arch; and the ends of the first and second support beams are fixed to ground at respective foundations that are proximal to locations where the respective first and second decks' corresponding deck ends reach ground support.

17. The bridge structure of claim 15, wherein:

the substantially vertical suspension members extend downward from support beam connections, which are longitudinally spaced apart along the first and second support beams, to deck attachment points, which are longitudinally spaced apart along the corresponding one of the first and second decks.

18. The bridge structure of claim 15 wherein:

the suspension members are arranged such that each one extends upward at no more than about 45 degrees off vertical from where it is supportingly connected to a deck.

19. The bridge structure of claim 9, wherein:

the first support beam extends in a lateral direction from its beam ends toward its laterally curved part;

the first support beam's laterally curved part leaningly contacts the laterally curved part of the second support beam; and the second support beam extends further in said lateral direction from its laterally curved part toward the second support beam's ends.

20. The bridge structure of claim 1 wherein:

the suspension members are arranged such that each one extends upward at no more than about 23 degrees off vertical from where it is supportingly connected to the deck.

* * * * *